United States Patent [19]

Martinsen

[11] Patent Number: 4,932,537

[45] Date of Patent: Jun. 12, 1990

[54] RACKING PALLET FOR OIL FIELD DRILL PIPE SECTIONS

[76] Inventor: Rick J. Martinsen, 635 North Vernal Ave., Vernal, Utah 84078

[21] Appl. No.: 909,646

[22] Filed: Sep. 22, 1986

[51] Int. Cl.[5] ..... A47F 7/00

[52] U.S. Cl. ..... 211/70.4; 211/60.1; 175/85

[58] Field of Search ..... 211/70.4; 414/22; 108/55.3, 901, 56.3, 55.1; 280/24, 12 M, 15; 206/386, 443, 564, 598; 175/85, 52

[56] References Cited

U.S. PATENT DOCUMENTS

| | | | |
|---|---|---|---|
| 1,750,798 | 3/1930 | Gidley | 211/70.4 X |
| 2,258,960 | 10/1941 | Rymal | 211/70.4 |
| 2,774,474 | 12/1956 | Phillips | 206/386 X |
| 2,781,185 | 2/1957 | Robbins | 211/70.4 X |
| 3,073,613 | 1/1963 | Bergstom, Jr. | 280/24 |
| 3,690,691 | 9/1972 | Kampe | 280/24 |
| 3,880,092 | 4/1975 | Seeber et al. | 108/901 X |
| 4,445,579 | 5/1984 | Bello | 211/70.4 X |
| 4,516,677 | 5/1985 | Rowland et al. | 108/553 X |

FOREIGN PATENT DOCUMENTS

| | | | |
|---|---|---|---|
| 2706554 | 8/1978 | Fed. Rep. of Germany | 108/901 |

*Primary Examiner*—Blair M. Johnson

*Attorney, Agent, or Firm*—Lynn G. Foster

[57] ABSTRACT

A pallet comprising a protective body of elastomeric material defining an array of recesses, each temporarily and protectively receiving the lower end of a pipe section, drainage structure being provided to accommodate removal of undesired liquid from recesses.

8 Claims, 3 Drawing Sheets

RACKING PALLET FOR OIL FIELD DRILL PIPE SECTIONS

FIELD OF INVENTION

The present device relates generally to storage of pipe sections and, more particularly, to a pallet for storing oil field drilling pipe sections and the like. The pipe is stored as a vertical array of pipe sections, each disposed with one end resting upon the pallet in such a way as to prevent damage to pipe threads and other pipe parts.

PRIOR ART

It is common in many industries, and particularly in the oil drilling industry, to stack pipe sections on one end for ease of access and conservation of space. In the oil industry, stands of drill pipe and casing are commonly stacked vertically in a drilling derrick when changing bits, fishing, or performing other downhole operations.

The practice of stacking pipe vertically (called "racking") often has a deleterious effect on the pipe. As the pipe is racked, the lower end of the pipe (which comprises exposed male threads) sometimes strikes against the surface on which it is being racked, or against other stands of pipe, causing damage to the threads. Also, drilling pipe is often lined with an anti-corrosive plastic sheath which may be damaged by rough handling.

In the past, these problems have been addressed through the use of end caps, usually formed of sheet metal, which are threaded onto the lower end of the pipe before racking. These caps present several disadvantages.

First, the caps must be individually removed and replaced every time a stand of pipe is run in or out of the hole. This operation necessarily slows the work. Furthermore, since the full weight of the pipe bears on the cap, the caps will often bind on the threads. Although the caps are generally only tightened by hand before racking, they must often be loosened with a 36-inch pipe wrench before they can be removed. This operation slows the work even more.

A number of safety problems are also associated with the use of sheet metal caps. For example, as drilling mud drains down the interior walls of the pipe, it collects in the cap. If not allowed to escape, it tends to harden or cake at the bottom of the pipe, clogging the pipe.

A clogged pipe may pose any number of drilling risks, ranging from unnecessary delay to blowout. As a result, it is a common practice, where metal caps are employed, to clean out the interior of the pipe before returning to the hole. In most cases, clogs are cleared with the fingers just before the stand is connected to the drilling string. If the stand is lowered too soon, however, the roughneck performing the operation may easily injure or sever fingers in the joint. This kind of accident is not uncommon.

To alleviate this problem, a drain hole is commonly provided to allow the mud to escape. However, since the racked pipe stands on the cap, the drain hole is typically obstructed. If the pipe is racked on a muddy surface, as is often the case, mud and other debris may actually be forced into the pipe through the drain hole. Under such conditions, the drain hole may not only be ineffective, but may even be worse than no drain at all.

The present invention is designed to eliminate or alleviate the aforementioned and other deficiencies associated with the prior art.

BRIEF SUMMARY AND OBJECTS OF THE INVENTION

In brief summary, the present invention comprises a novel pipe racking pallet, which, among other things, eliminates the need for protective end caps for pipe. The normal environment of use for the pallet is in the field, where oil drilling is occurring. The pallet safely and protectively stores an array of spaced vertically-extending pipe sections. The pallet comprises a resilient pad to protect relatively delicate liners, threads or other pipe parts. In the presently preferred embodiment for oil field use, the pallet comprises an effective drain system to prevent clogging, reducing or eliminating the need to manually clear clogs when returning pipe to the hole. The pallet may be mounted on a sled or skids, so it can be easily moved or repositioned, as needed.

With the foregoing in mind, it is a primary object of the present invention to provide a novel storage rack or pallet for securing drilling or other pipe sections in a spaced vertical array.

It is a further important object of the present invention to provide a novel storage device for pipe sections which prevents damage to pipe threads and liners by surrounding the end of each pipe section in a protective enclosure.

It is a further significant object of the present invention to provide a novel storage device for pipe sections which prevents clogging and corrosion by providing drainage structure for each pipe section.

It is a further paramount object to provide a novel pallet for field storage of a plurality of sections of drill pipe in a safe, damage-free and readily accessible condition.

These and other objects of the present invention will be apparent from the detailed description taken with reference to the accompanying drawings.

DETAILED DESCRIPTION OF THE ILLUSTRATED EMBODIMENT

Figure 1:
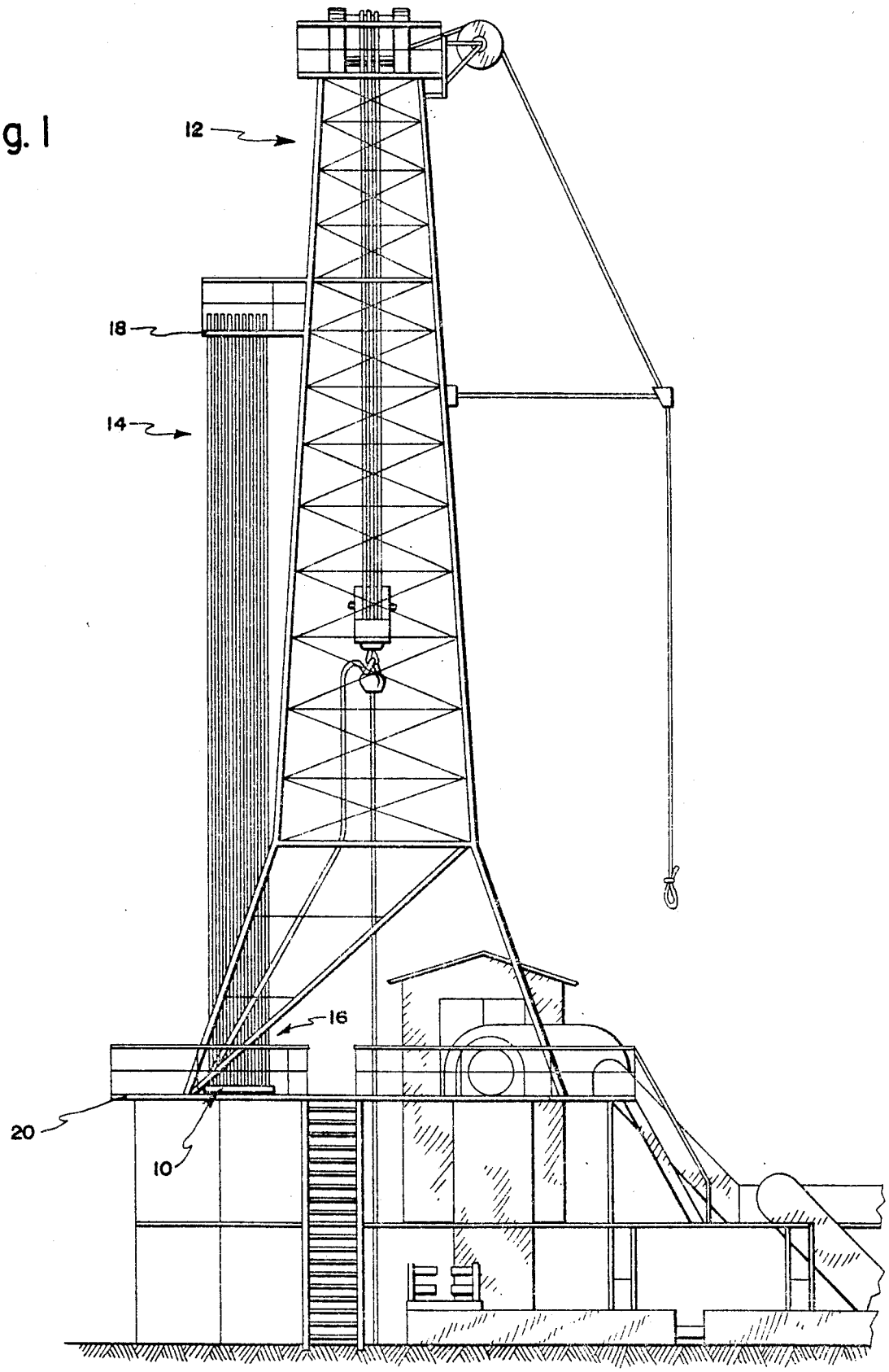
FIG. 1 is a side elevation of a typical oil drilling derrick, showing drilling pipe racked on a drilling platform in a pipe pallet according to the present invention.

Referring now to the drawings, and particularly to FIG. 1, there is shown a pipe racking pallet, generally designated 10, formed according to the principles of the present invention. The pallet is shown in use on an oil drilling derrick, generally designated 12, holding stands or sections of drill pipe 14, the upper ends of which are racked in conventional fingers 18 of derrick 12. The pallet 10 separates and protects the lower ends of pipe sections 16, preventing them from being crushed or struck against each other or other locations, such as the drilling floor 20.

Figure 2:
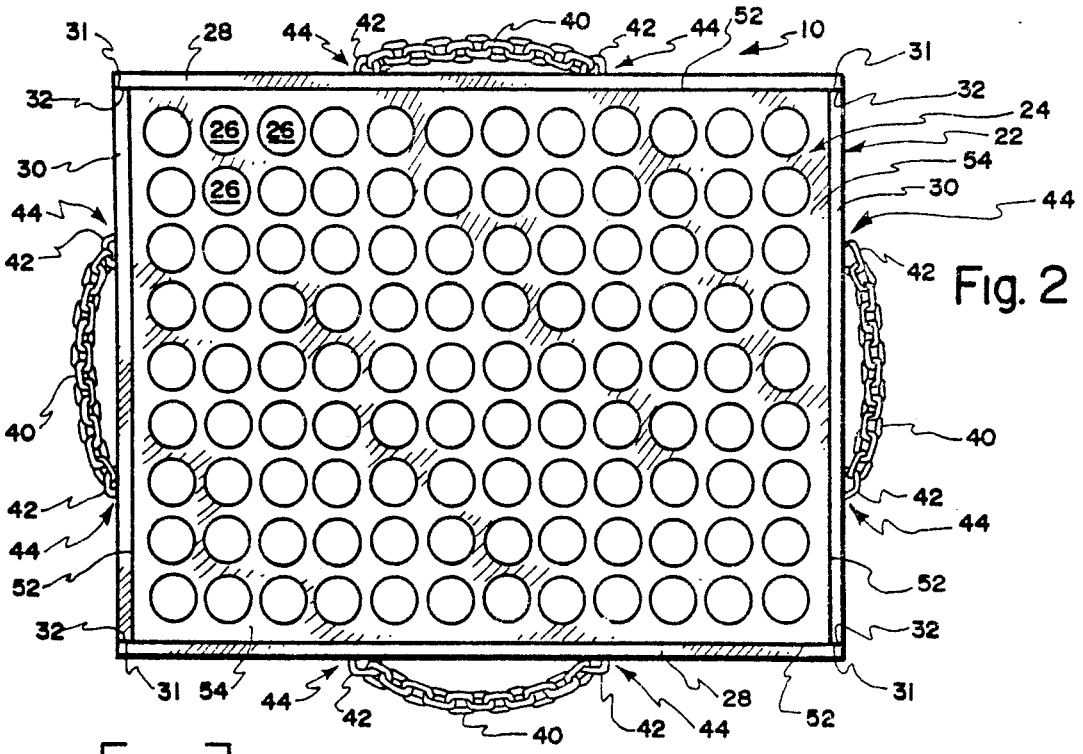
FIG. 2 is an enlarged plan view of the pipe rack pallet of FIG. 1.
Figure 3:
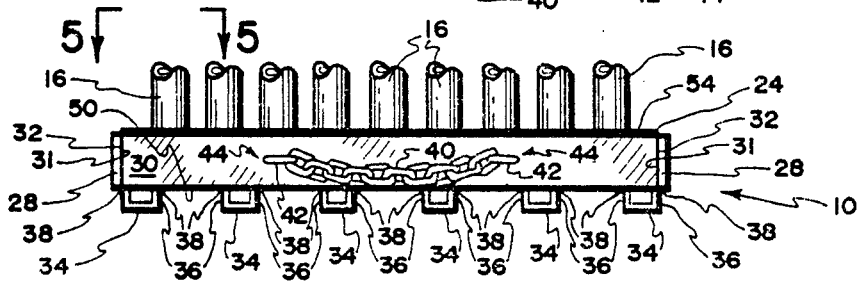
FIG. 3 is a side elevation of the pallet of FIG. 2, viewing the shorter of the two dimensions.
Figure 4:
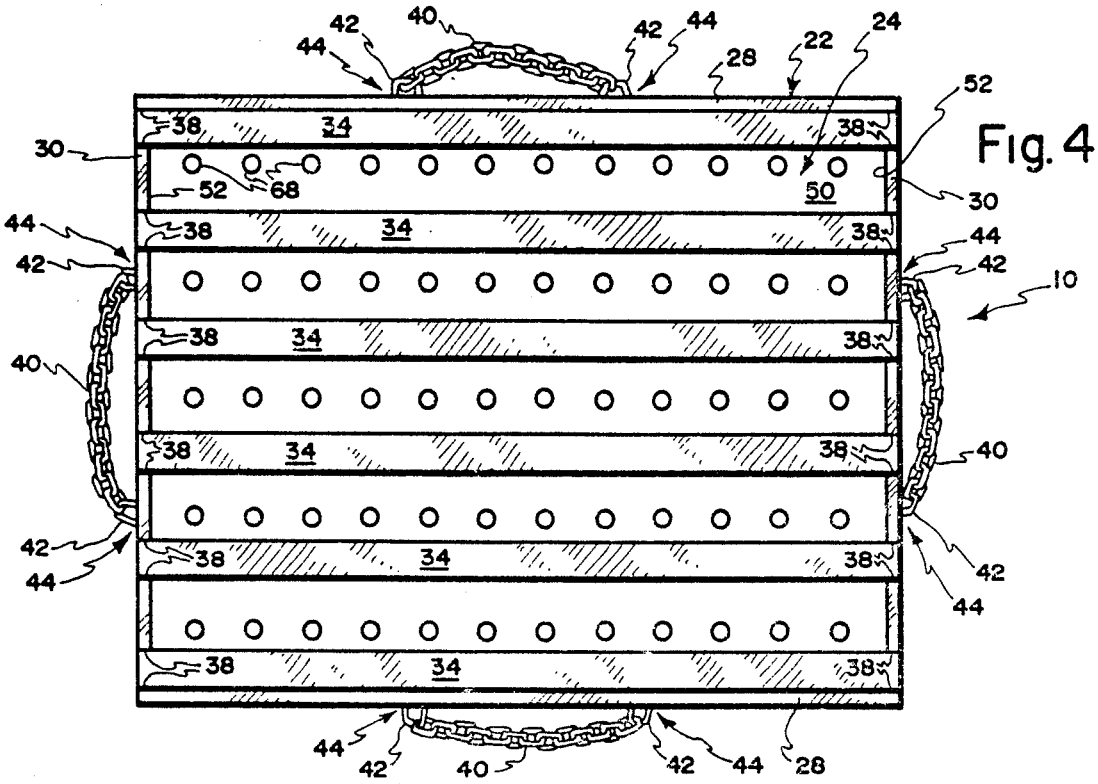
FIG. 4 is an enlarged bottom plan view of the pallet of FIG. 2.

FIGS. 2, 3 and 4 are enlarged top, end, and bottom views, respectively, of the pallet 10. In the presently preferred embodiment, the pallet 10 comprises a frame, generally designated 22 and a resilient pad 24, of suitable elastomeric material, such as neoprene, in which a plurality of enclosures, wells or cavities 26 are disposed in an array. As successive stands of pipe 14 are pulled from a drilling hole, for example, the lower pipe ends 16 are successively inserted available in enclosures or recesses 26 and the upper ends are conventionally racked in the fingers 18 of the derrick 12.

In the illustrated embodiment, the frame 22 of pallet 10 is rectangular and comprises two pairs of parallel sides: i.e. parallel long sides 28,;being identical of opposite hand, and parallel short sides 30, being also identical but of opposite hand, and parallel short sides 30, being also identical but of opposite hand. Sides 28 and 30 are perpendicular. All four sides 28, 30 are identical in vertical height and in thickness, being preferably constructed of ordinary flat steel stock, although other suitable materials might be used. The height of sides 28, 30 is preferably slightly less than the thickness of the resilient pad 24, preventing the lower end 16 of each pipe section from striking the sides 28, 30 of the frame 22. The thickness of sides 28, 30 may vary, but thicknesses between 0.25 and 0.5 of one inch normally provides the requisite strength, without adding unnecessary weight.

Short sides 30 are illustrated as being equal in length to the length of the shortest side of the resilient pad 24. Lower sides 28 are illustrated as being slightly greater in length than the length of the long side of the pad 24, i.e. to cover the blunt ends of shorter side pieces 30 The side pieces 28, 30 are assembled integrally by welding, for example, the butt ends 31 of short sides 30 thereby being connected to the inside ends 32 of long sides 28 so as to form the rectangular frame 22 of generally the same inside dimensions as the outside dimensions of the resilient pad 24.

Spaced runners or skids 34 are integrally disposed along the bottom of the above-described rectangular frame 22. Runners 34 support the resilient pad 24 and permit the pallet 10, when empty, to be slidingly relocated. Runners 34 are illustrated as being of the same length as long side pieces 28 and illustrated as being positioned parallel to long sides 28, so as to minimize resistance to motion parallel to the runners 34 and maximize leverage for turning. Runners 34 may be formed of common channel-shaped steel, with the flanges 36 thereof directed upwardly toward the frame 22. The ends of the runners 34 are preferably attached to the lower part of both short side pieces 30 of the frame 22 by welding at sites 38. The placement of the runners 34 should not interfere with the operation of drain holes, as hereinafter described.

Handles 40 are attached to the sides 28, 30 to facilitate manual and mechanized repositioning. In the illustrated embodiment, the handles 40 comprise lengths of chain, secured to each side 28, 30. Each handle 40 should be sized to be capable of receiving anticipated loads and forces and should be long enough to allow grasping manually or by a hook or other mechanical means for attachment to the winch, tow chain, tow cable or the like. Handles 40 are preferably attached by welding the ends 42 of each handle 40 to the side walls 28, 30 at points 44 which are equidistant from ends of the side 28, 30 and spaced from each other slightly less than the length of the handle chain 40. Thus, the handle 40 is somewhat slack and can be grasped easily. The handle 40 should not have so much slack as to bind under the runners 34 or otherwise interfere with the use of the pallet 10.

The pad 24 is preferably molded from resilient material, such as neoprene, so as to have a substantial thickness. For oil field use, a thickness of approximately three inches has been successfully employed. The pad 24 is placed snugly inside the rectangular frame 22, so that a substantially planar lower surface 50 rests against and is supported by the runner flanges 36. Additional support can be provided as desired. The vertical side edges 52 of the pad 24 are snugly contiguous with the walls 28, 30 of the frame 22, which prevents the pad 24 from sliding relative to the pallet frame 22. A substantially planar upper surface 54 of pad 24 is upwardly exposed.

Blind enclosures, wells or cavities 26 are formed, preferably during molding, in an array configuration, with each well 26 being fully exposed at the upper surface 54 of pad 24. Enclosures 26 are regularly spaced in a matrix of 9 by 12 enclosures in the illustrated embodiment, giving storage space for 108 lengths of pipe.

Figure 6:
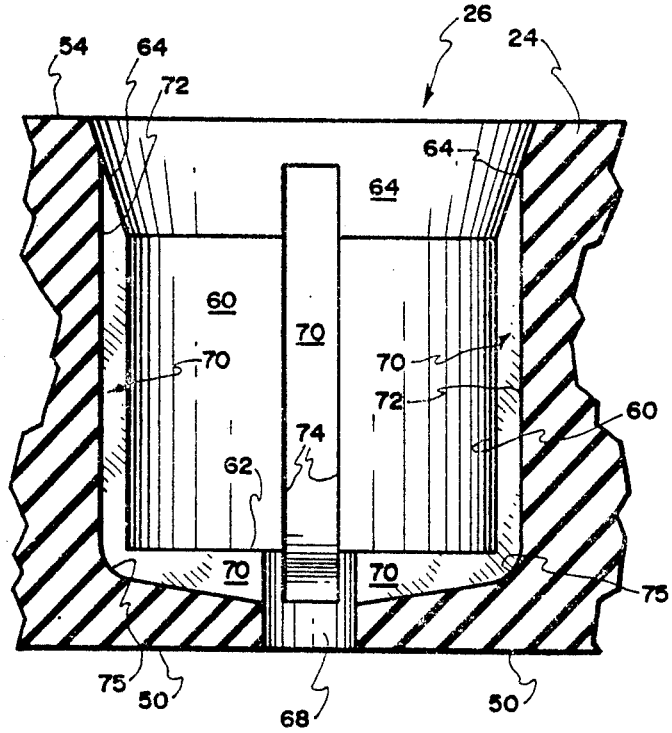
FIG. 6 is a fragmentary cross section taken along the lines 6—6 of FIG. 5.

FIG. 6 illustrates one enclosure 26 in cross section. Each enclosure 26 comprises an annular side wall 60, disposed more or less vertically and in perpendicular relation with the top surface 54. The side wall 60 has an inside diameter slightly larger than the outside diameter of the pipe with which the pallet 10 is to be used. A floor or base surface 62 of each well 26 is disposed in a substantially parallel relationship to the top surface 54, closing off the end of the enclosure 26 and forming a blind hole, except as hereinafter explained.

In the illustrated embodiment, cylindrical enclosure side wall 60 merges with a frusto-conical tapered upper side wall 64. Upper side wall 64 intersects and forms an obtuse angle with the top surface 54 of pad 24, making the enclosure 26 wider at the top surface 54 than at the floor 62. This permits the lower pipe end 16 to be easily introduced into the enclosure 26. Side wall 60 is essentially vertical, which facilitates the proper seating of pipe end 16 on the floor surface 62 and prevents undue lateral rotation of the pipe about the floor 62.

A cylindrical drain hole 68 is centrally disposed in each well 26, through the base surface 62 to the pad lower surface 50. Thus, the interior of the enclosure 26 communicates with the lower pad surface 50, permitting drainage of drilling mud, rain, melted snow and other fluid from the interior of the pipe 14 and the well 26. Drilling mud would otherwise collect in the enclosure 26 or be retained within the pipe. As stated earlier, runners 34 should be positioned so as to avoid obstruction of drain holes 68.

Channels or drainage grooves 70 are formed, preferably during molding, into the walls of each enclosure 26, allowing mud, water and the like trapped between the exterior wall of pipe end 16 and the enclosure side wall 60 to pass to the drain hole 68. Each channel 70 is L-shaped and comprises a back wall 72, which determines the depth of channel 70, and two side walls 74 disposed in parallel relation to each other and generally radially from the central drain hole 68, the spacing of which determines the width of each channel 70.

Each channel 70 merges with the tapered upper side wall 64 of the associated enclosure 26. The back wall 72 of each channel is substantially vertical, creating a channel depth divergence from the angled upper side wall 64, which increases until the upper enclosure wall 64 joins the more nearly vertical lower side wall 60, at which point the divergence substantially ceases and the depth of the channel 70 becomes constant. The depth of the channel 70 may of course be adjusted by raising or lowering the beginning point of the channel 70 on the upper side wall 64. A channel depth of approximately 0.5 inches is normally sufficient for adequate drainage.

At the bottom of the enclosure 26, the vertical leg of each L-shaped channel 70 merges with the horizontal leg of the channel. The horizontal leg in turn is in liquid drainage communication with the center hole 68. A radially curved corner 75 joins the vertical and horizontal legs of each channel 70. The base surface of the horizontal leg of each channel slopes toward the drain hole 44 at an angle steep enough to ensure good drainage.

Figure 5:
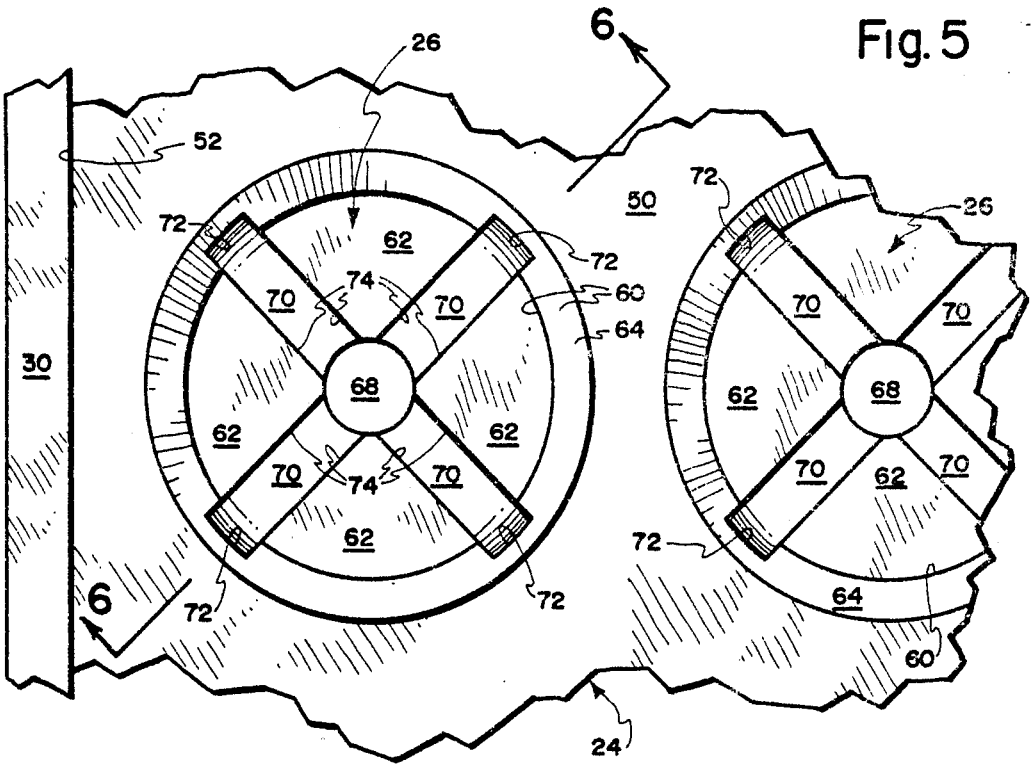
FIG. 5 is a greatly enlarged fragmentary plan view of the pallet of FIG. 2, taken along the line 5—5 of FIG. 3 illustrating the details of the pipe end receiving wells.

FIG. 5 is a top view of one enclosure 26, showing the presently preferred relationship between the channels 70 thereof, the enclosure side wall 60 and the drain hole 68. Any desired number of channels 70 may be employed in each enclosure 26 to secure adequate drainage If so the channels 70 are preferably radially distributed around the circumference of the enclosure 26. The illustrated embodiment shows four such channels 70 disposed at ninety degree intervals around the enclosure 26. The channels 70 are disposed at 45 degree angles to the adjacent enclosures so as to minimize structural weakening of the pad 24.

The invention may be embodied in other specific forms without departing from the spirit or essential characteristics thereof. The present embodiment is, therefore, considered in all respects as illustrative and not restrictive, the scope of the invention being indicated by the scope of the appended claims rather than by the foregoing description, and all changes which come within the meaning and range of equivalency of the claims are therefore intended to be embraced therein.

What is claimed and desired to be secured by United States Letters Patent is:

1. A pallet adapted to temporarily receiving and storing threaded lower ends of a plurality of vertically oriented pipe sections safely and protectively against end and thread damage, the pallet comprising pad means comprising a unitary body of yieldable though durable elastomeric material, the body comprising a substantial length greater than several diameters of each section of pipe to be stored and a substantial width greater than several diameters to be stored, the body further comprising a depth between upper and lower surfaces greater than the length of the threads at the lower ends of the pipe sections to be stored, the top surface being interrupted by an array of spaced recesses, each recess comprising an opening at the top surface, each recess comprising a side wall slightly greater in transverse dimension than the diameter of the lower threaded end of the pipe section to be stored therein, each side wall comprising a depth less than the depth of the body but at least substantially equal to the length of the threads at the lower end of the pipe section to the stored therein, each recess comprising a floor wall which merges with the associated side wall and upon which the pipe section edge to be stored therein rests during storage.

2. A pallet according to claim 1, wherein each recess side wall comprises a cylindrical surface with a diameter slightly greater than the outside diameter of the threads at the lower end of the pipe section to be inserted therein, and comprising a depth slightly greater than the length of the threads at the lower end of the pipe section to be inserted therein.

3. A pallet according to claim 1 wherein the opening of each recess is upwardly divergently tapered and comprises a frusto-conical shape.

4. A pallet according to claim 1 further comprising drainage structure extending through each floor wall to the lower surface of the body.

5. A pallet according to claim 4, wherein the drainage structure comprises at least one slot disposed in the side wall of each recess accommodating drainage of liquid from each recess.

6. A pallet according to claim 1, wherein the pallet further comprises ground-engaging sled means located beneath the lower surface by which the pallet is relocated without disassembly.

7. A pallet according to claim 6 further comprising tow means for manually and mechanically displacing the pallet from place-to-place intact without disassembly.

8. A pallet according to claim 1, further comprising rigid frame means disposed around the perimeter of the elastomeric body.

* * * * *